US010259546B2

(12) United States Patent
Birkin

(10) Patent No.: US 10,259,546 B2
(45) Date of Patent: Apr. 16, 2019

(54) RECOVERY SYSTEM

(71) Applicant: Jeffrey William Birkin, Clevedon (GB)

(72) Inventor: Jeffrey William Birkin, Clevedon (GB)

( * ) Notice: Subject to any disclaimer, the term of this patent is extended or adjusted under 35 U.S.C. 154(b) by 0 days.

(21) Appl. No.: 15/329,713

(22) PCT Filed: Jul. 30, 2015

(86) PCT No.: PCT/GB2015/052201

§ 371 (c)(1),
(2) Date: Jan. 27, 2017

(87) PCT Pub. No.: WO2016/020649

PCT Pub. Date: Feb. 11, 2016

(65) Prior Publication Data

US 2017/0210452 A1 Jul. 27, 2017

(30) Foreign Application Priority Data

Aug. 3, 2014 (GB) ..... 1413744.2
Mar. 31, 2015 (GB) ..... 1505567.6

(51) Int. Cl.
*B63C 9/11* (2006.01)
*B63C 9/26* (2006.01)
(Continued)

(52) U.S. Cl.
CPC ..... *B63C 9/11* (2013.01); *B63C 9/26* (2013.01); *B63B 2201/00* (2013.01);
(Continued)

(58) Field of Classification Search
CPC ..... B63C 9/11; B63C 9/26
(Continued)

(56) References Cited

U.S. PATENT DOCUMENTS 3,103,022 A * 9/1963 Harding ..... B63C 9/1255 441/94
3,877,096 A 4/1975 Scesney
(Continued)

FOREIGN PATENT DOCUMENTS

CA 2 690 574 7/2011
FR 757 510 12/1933
(Continued)

OTHER PUBLICATIONS

International Search Report and Written Opinion of the International Searching Authority dated Jan. 11, 2016 in International (PCT) Application No. PCT/GB2015/052201.
(Continued)

*Primary Examiner* — Stephen P Avila
(74) *Attorney, Agent, or Firm* — Wenderoth, Lind & Ponack, L.L.P.

(57) ABSTRACT

Described herein is a device for recovering an object from water comprising an object attachment point, for attaching the device to the object, and an inflatable and/or buoyant target mesh element, the attachment point and target mesh element being linked by an extendible line portion which is extendible when placed under longitudinal pressure. Such a "Man Overboard Recovery System" allows a vessel to remain under proper control in difficult weather conditions when dealing with a casualty recovery situation.

19 Claims, 6 Drawing Sheets

(51) Int. Cl.

| | |
|---|---|
| *B63C 9/125* | (2006.01) |
| *B63C 9/115* | (2006.01) |
| *B63C 9/13* | (2006.01) |
| *B63C 9/15* | (2006.01) |

(52) U.S. Cl.
CPC ..... *B63C 9/115* (2013.01); *B63C 9/1255* (2013.01); *B63C 9/13* (2013.01); *B63C 9/155* (2013.01); *B63C 2009/265* (2013.01)

(58) Field of Classification Search
USPC ..... 114/215
See application file for complete search history.

(56) References Cited

U.S. PATENT DOCUMENTS

| | | | | |
|---|---|---|---|---|
| 4,004,310 | A | 1/1977 | Faulstich et al. | |
| 5,374,211 | A * | 12/1994 | Imazato | B63C 9/02 114/365 |
| 5,421,287 | A | 6/1995 | Yonover | |
| 5,906,173 | A * | 5/1999 | Day, Jr. | B63B 21/24 114/215 |
| 6,659,823 | B1 * | 12/2003 | Mosna | B63C 9/26 441/84 |
| 6,953,374 | B1 * | 10/2005 | Connolly | B63C 9/26 43/13 |
| 2002/0119715 | A1 * | 8/2002 | Pons | B63C 9/00 441/80 |
| 2004/0023574 | A1 | 2/2004 | Calkin | |
| 2005/0221700 | A1 | 10/2005 | Weinel | |
| 2011/0177732 | A1 * | 7/2011 | Clifford | B63C 9/065 441/38 |

FOREIGN PATENT DOCUMENTS

| | | |
|---|---|---|
| FR | 2 365 477 | 4/1978 |
| GB | 2 336 134 | 10/1999 |
| GB | 2 461 719 | 1/2010 |
| JP | 7-304492 | 11/1995 |
| WO | 2010/004318 | 1/2010 |

OTHER PUBLICATIONS

Search Report under Section 17 dated Dec. 16, 2014 in corresponding GB Application No. 1413744.2.
Search Report under Section 17(5) dated Jun. 11, 2015 in corresponding GB Application No. 1505567.6.

* cited by examiner

A

B

C

RECOVERY SYSTEM

FIELD OF INVENTION

The invention relates to an object overboard recovery system device for making secure contact with an object in water, especially an individual and particularly in open water on a river or sea. The device facilitates the rapid recovery of that object.

BACKGROUND

When a person falls from a vessel or otherwise finds him/herself unavoidably in the sea or other areas of open water, they are referred to as a "casualty". This is due to the fact that exposure to such conditions can quickly cause numerous physical consequences that eventually may lead to the death of the person. Survival limits can sometimes be measured in minutes. The odds of survival are increased dramatically by the wearing of a buoyant safety harness and means to assist in the rapid location of the casualty.

For example, WO2010/004318 discloses a system for increasing the visibility of a casualty in the water, by deployment of a visible inflatable portion which is constructed such that an open configuration is maintained after deployment. The device "rides the waves" and continues to be visible even in rough water. The "streamer" devices disclosed in U.S. Pat. No. 5,421,287 and JP07304492 aim to achieve a similar effect, by means of "streamer" elements which can be packaged for easy wear by a user and caused to unfurl if the user finds themselves in water. US2005/0221700 discloses an inflatable bladder which can be tethered to a person or apparatus via a line, the bladder and line being packaged together in such a way that, if the person or apparatus is submerged, the bladder and line are released. The bladder inflates as a ring structure and floats to the surface. Similarly, U.S. Pat. No. 4,004,310 and FR757510 disclose systems of packaging a line within a marker buoy such that, if a user or object is submerged, the buoy can be released and float to the surface, remaining attached to the user or object via the line which pays out freely from within the buoy.

Even with such buoyancy and visualisation aids, time is usually incredibly valuable for the survival of the person. The extreme difficulties encountered in manoeuvring the vessel, securing the casualty and bringing them back aboard are often insurmountable. Any delay waiting for assistance from the Coastguard and other rescue services results, even when recovering the person alive, in their subsequent death despite the best medical care available. This is of particular concern for crews in waters which may be hundreds or even thousands of miles from land.

It must be understood that the handling characteristics of a vessel changes as speed changes in any given condition. The worse the conditions, the more profoundly the characteristics change. Therefore, sailing yachts in rough seas can be stable at speed when 90° to the wind with precise helm control available. However, they become very unstable and almost impossible to steer when pointing to wind at less than 1 knot in the same seas. Also, orientated at an angle close to the wind direction usually results in the waves arriving from a similar direction. This tends to excite the pitching action which can become very violent, especially if the waves match the natural frequency of the vessel. During this phase, the rig of a yacht becomes a serious hazard if control lines begin to flog or the boom sweeps above the deck unexpectedly. Rigging lines can become tangled then tensioned inappropriately leading to loss of control. As speed approaches zero, steerage is completely lost and the force of wind on the hull and superstructure, combined with the action of the waves, dictate the location and movement of the vessel. Similar is true for power driven vessels. All vessels with zero forward motion rotate so their bows point substantially downwind and they drift in a downwind direction. It is possible to counteract this to a greater or lesser extent with a power driven vessel but sailing vessels are particularly badly affected. These effects can render the time window when the casualty is in close range during a recovery attempt very short indeed, making further recovery attempts necessary. Small craft can be so unstable that it can be hazardous to conduct slow speed manoeuvres in rough seas. Therefore, few sailors ever practice or attempt precise manoeuvring at slow speed in rough weather.

Various National and International marine organisations suggest assorted manoeuvres for rapidly returning the vessel to the location of the casualty and recommend that such manoeuvres are practiced regularly. Typically, such practice is conducted in fair weather with the casualty simulated by a flotation device (often a fender) attached to a drag device (often a bucket) by means of a short length of rope. Such a rope is relatively easy to pick up by a sweeping action with a boat hook below the surface of the water aiming between the flotation device and the drag device.

Even with such an easily secured object as above, poor sea conditions can make attaching the boat hook difficult, necessitating many attempts. The combined effect of the motions in even modest seas can result in rapidly changing vertical distance between the object to be picked up and the vessel from which the person attempting the pickup is deploying the boat hook. Due to the necessity to have the maximum time available in contact with the object to carry out this task, it is usual to first attempt the pickup from the fore part of the vessel where the pitching motion is amplified by the distance from the centre axis of buoyancy. This is particularly so in a motor driven vessel where the recovery must be towards the bow to avoid the possibility of the casualty contacting the propeller situated aft. In all cases, if this fails, the rescuer moves further aft if sufficiently close to the casualty for a second attempt.

Almost universally, the adopted 'best practice' involves the vessel manoeuvring to a position placing it upwind of the casualty, the rationale being that it allows the vessel to be in close proximity to the casualty for the longest period of time before natural forces can separate the parties. During this brief period, the crew must try to firmly hold the casualty. In the case of a yacht, this usually means lying on the deck and reaching down beneath the guard rails into the water. On a pitching yacht in a rolling sea, when water is coming over the deck, this may lead to the rescuer contacting the casualty and then having to hold them as their full weight (often 100-150 kgs for a person in soaked clothing) is transferred as the yacht rises, whilst the wave supporting the casualty falls. This places the rescuer in jeopardy of being pulled overboard and, in many cases, leads to the casualty being released due to excessive loading. Unfortunately, this manoeuvre also places the casualty below the curved hull of the vessel as the hull rises and falls. Apart from the consequences of an impact with the hull, it also can push the casualty underwater further straining the hold any crew may have and/or cause them to be lost to sight as the vessel moves on.

Unhappily, a casualty wearing a fully inflated lifejacket may have some advantages in terms of survival but is very restricted in their ability to assist in their own recovery. This is because the pontoons of the jacket form an unfamiliar and formidable barrier to arm movements towards the front of the body, above the waterline or above the head.

Some methods recommend using the swim platform or ladder at the stern of the vessel. However, in rough seas, the ladder becomes extremely dangerous and the stern has all the characteristics of an extremely large hammer.

The recovery situation of a real casualty, as opposed to the simulation used in exercises, is far worse. A marine safety harness is manufactured from webbing that lies flat conforming to the casualty's body shape. Some are provided with a lifting Becket consisting of a webbing loop which is stored flat, offering almost no opportunity for entry of a boat hook and sometimes needs the active intervention the casualty to deploy. The other obvious lifting point is the D ring used to attach the harness line. This is typically around 2 inches in diameter, offering a very small target which may be flat against the body and will be submerged and concealed beneath the supporting pontoons of the lifejacket.

This is clearly illustrated by a report to Solent Coastguard on 20 Jun. 2014 where the crew of a yacht failed, after several attempts, to recover a rescue dummy in sheltered water at the mouth of the River Hamble in excellent weather and sea conditions.

A conscious casualty may be able to grab a boat hook and assist in attaching a line. In addition to being conscious, the casualty would need sufficient mental faculties and manual dexterity. Cold water will rapidly reduce cognitive abilities, manual dexterity and strength as was highlighted by the UK's Marine Accident Investigation Branch (MAIB) in the case of the vessel Vidar: "Many fishermen erroneously believe that a person falling overboard can help themselves in some way once a rope is thrown to them or a ladder is lowered. However, MAIB investigations have identified numerous accidents where fit and healthy persons who have fallen overboard have lost all ability to help themselves within a minute or two due to the debilitating effects of cold water shock and ingestion of water." (MAIB Very Serious Marine Casualty Report no. 19/2013, August 2013)

An alternative method of rescue involves the use of a device called a Lifesling® or Seattle Sling which can be effective with conscious casualties who retain sufficient manual dexterity to don it following contact. The equipment is most effective if the casualty is able to catch the line or the vessel is manoeuvred around the location of the casualty until they are in contact with the line and then able to pull the sling into position. Unfortunately, in any rough sea, a casualty may be unlikely to be able to see the line as it comes into contact with them and may not be able to distinguish the difference in feel between water sloshing over their face and the fall of a line. Furthermore, the skill level of the rescuers must be relatively high to allow them to manoeuvre in an arc around the casualty yet ensure they avoid simple mistakes such as allowing the lifting line to become tangled in the propeller. However, this equipment is frequently carried as standard equipment on many vessels but, to lift the casualty requires that a block and tackle is available, something that is rarely found on most modern yachts.

Another method of bringing a casualty back aboard is by means of a Jason's Cradle® or similar. This is a form of netting that is rarely successful in rough seas due to the alternating buoyancy of the netting. In addition, it may require multiple rescuers working in close coordination to properly operate unless substantial deployment machinery is already installed on the vessel.

Many other devices involve throwing lines and dropping equipment into the water for the casualty to find and deploy. They all offer some benefits however, they also provide multiple tangle and hindrance opportunities in the rescue area if not used and usually require considerable input from a conscious casualty who retains manual dexterity. US2004/0023574 describes a throw bag which may be worn on the body of a person, containing a line the end of which is attached to the person at a different point. If they are able to, they may release the throw bag from its location when worn whilst leaving the end of the line attached to them, open the lid to free the remainder of the line and throw the bag towards a rescuer. It is easy to see how such a manoeuvre might be difficult for a casualty who has fallen overboard in high seas, wearing an inflated life jacket.

Therefore, there is a need for an effective, simple, low cost device that is intuitive in use and makes use of the standard vessel equipment and systems without adding further dangers when used, for example caused by loose floating lines in the water, allows the vessel to be under full control for as long as possible during the contact phase and not require positioning that places the casualty or rescuers in jeopardy. Furthermore, the operational skill level requirement must be low to allow for both the confusion caused during the extremely stressful situation of a genuine MOB and minimum skill levels that may be available. The device should be available to be manufactured with a new harness, equipment or clothing or retrofitted to existing harnesses and other related equipment.

SUMMARY OF INVENTION

According to a first aspect of the invention, there is provided a device, for recovering an object (such as a person) from a liquid such as water, comprising at least one object attachment point, for attaching the device to the object, and at least one inflatable and/or buoyant target mesh element, the attachment point and target mesh element being linked by, or having arranged between them, at least one extendible line portion which is extendible only when placed under longitudinal pressure or force. That is, the extendible line portion may be caused to extend to extended form, in use, by pulling both ends of the line away from one another, or by maintaining one end of the line at a fixed point and pulling the other end of the line.

Preferably, the device is useful for locating and recovering a floating object or an object partly or fully submerged in a liquid, typically water.

As discussed in more detail below, the target mesh element may be convertible between an undeployed state and a deployed state, the target mesh element comprising an inflatable and/or buoyant portion or portions and means for inflation of the inflatable portion or portions, where present. The term "target mesh element" indicates a portion of the device formed by one or more portions of usually linear material (such as one or more lines and/or wires which may or may not be flexible) arranged to form at least one aperture through which a device such as a boat hook may engage with the target mesh element. The engagement may be reversible or irreversible. Therefore, the target mesh element may take a circular form, or may form or be formed by a net or mesh comprising two or more apertures. The precise configuration of the target mesh element is not critical, so long as it provides means suitable for engagement with the device by a rescuer seeking to recover the object from the liquid. For example, this may be via a direct manual grab by a rescuer using their hands, or preferably using a boat hook or other target engagement means. In an embodiment, the material forming the target mesh element is flexible, such that, once engaged with an engagement means such as a boat hook, the target mesh element wraps around or tangles with the hook to facilitate the rescue and discourage loss of engagement between the rescuer and the target mesh element. Non-limiting examples of suitable configurations for the target mesh element are described elsewhere herein and in the Figures.

There is also provided means for attachment of the target mesh element to the extendible line portion. The target mesh element optionally may be attached to the extendible line portion via one or more pivot points.

The term "lifting line" as used herein may refer to a component of the extendible line portion and, in some embodiments, may be equivalent to the fully extended form of the extendible line portion. In an embodiment of the device, the extendible line portion may be a packaged length of lifting line, formed as a package such that each end of the line emerges from the package at a different point, wherein the extendible line portion remains in packaged form unless and until a longitudinal force is applied to one or both ends of the line. Any given section of the line remains in packaged form until it is caused to exit the package by the action of the longitudinal force. A longitudinal force or pressure on the line is one which acts along the length of at least part of the line, for example, resulting from the action of pulling an end of the line longitudinally away from the remainder of the line. The package may be essentially cylindrical or "sausage-shaped". One end of the line preferably emerges from the cylindrical package at one end and the other end of the line emerges from the other end of the package. However, any shape of package and any location within the package for the lines to emerge may be suitable. One end of the line may be fixed within the package forming the extendible line portion, with the other end capable of being pulled out from the package when a longitudinal force is applied.

Since the line remains in packaged form until it is caused to exit the package by the action of the longitudinal force, systems in which a line is packaged in such a way that the whole length of packaged line is released into an unrestrained arrangement all at once, in use, by the opening of the packaging around the line, are preferably not encompassed. In the present invention, the line "pays out" under the longitudinal force; if the force is removed before the whole line has emerged from the packaging, the remainder of the line remains packaged. In particular, the package comprises means for resisting the egress of the line, via means for providing a pre-determined resistance to a removing force, as outlined further below.

The extendible line portion may be irreversibly extendible, so that it does not retract if the longitudinal force applied to the line varies or ceases. Preferably, the extendible line portion is extendible under a longitudinal pressure of at least about 8 N, for example at least about 10, 15, 20, 25, 30, 35, 40, 45 or at least about 50 N. A longitudinal pressure of at least about 15-20 N is contemplated, for example. This ensures that the extendible line portion does not extend until a significant longitudinal pressure is applied to the line, in contrast, for example, to the low amounts of longitudinal pressure required to operate a simple throw line (estimated to be about 2-3 N). Such throw lines do not include means for providing a pre-determined resistance to a removing force, as described below, rather being intended to pay out immediately on throwing of the line. Throw lines also do not include a target mesh element or an object attachment point.

Therefore, the extendible line portion may be a line or lifting line contained within a containment package, which may be buoyant, comprising means for providing a pre-determined resistance to a removing force and packed in such a way as to facilitate smooth deployment of the line without tangles. That is, the line emerges from the containment package at a point wherein a portion of the material forming the package frictionally contacts (or engages with) the material forming the line, such that there is a frictional force placed on the line tending to resist the line being pulled from the package. As mentioned above, the longitudinal pressure must be maintained on the line for extension of the line to continue. This frictional contact may be achieved, for example, by frictionally encircling the line at the point where it emerges from the package, for example, with tape wound tightly enough that the line can only be pulled out under a given pre-determined force of, for example, at least about 5 N. A similar effect may be achieved by use, for example, of zip ties or clamps or grips such as a pinchcock clamp or a band clamp, or by simply forming an opening through which the line may emerge from the package, with dimensions sufficiently narrow that the line is frictionally encircled by the package material. The opening may be lined or "stopped" with a frictional element such as a bung comprising a central aperture through which the line may extend, the bung being formed from rubber, foam, or another suitable frictional material. One terminating end of the extendible or lifting line, at the opposite end of the line from the target mesh element, is connected by one or more pivot points (for example) to the object, life jacket or life preserver, life ring or sling or other flotation, sea survival or recovery apparatus.

In an embodiment in which the extendible line portion is a lifting line contained within a containment package, the containment package may optionally comprise an inner and an outer casing. The inner casing may comprise compressed end regions to allow expansion of the inner casing in the event that smooth deployment of the line is interrupted by the presence of a knot or tangle in the line. This enables expansion of the inner casing without causing damage to the casing at the point(s) where it makes frictional contact with the line. The compressed inner casing may be surrounded by an outer casing which may comprise a region of weakness capable of structural failure in the event that smooth deployment of the line is interrupted by the presence of a knot or tangle in the line. The failure of the outer casing allows the expansion of the inner casing as described above. Conversely, when the outer casing is intact, it prevents expansion of the inner casing when packed with lifting line and ready for use.

In the event that significant interruption of line deployment continues after failure of the outer casing and expansion of the inner casing, the frictional contact point of the inner casing may be formed such that it can release the frictional contact with the line and allow the line to exit freely from the packaging. For example, as described above, the frictional contact may be achieved by use of tape, zip ties, clamps or grips, any of which may be configured to break or fail if a sufficiently significant pressure is experienced during deployment of the line. Where the frictional contact is achieved by means of a bung positioned in an opening of the package, the frictional contact may be released simply by separation of the bung from the package opening.

In an alternative embodiment of the extendible line portion to that described above, the extendible line portion may be provided or partially provided by a lifting line formed from a material and/or formed in a shape such that, after a longitudinal force or pressure has been applied to the line so that it is extended, it does not contract to a shorter length such as to its original length, but is maintained in the extended conformation. For example, the line may be formed from an extendible but non-elastic material, or from an elastic material having an elastic limit which is surpassed under the loads required to cause extension of the extendible line, when the device is in use. Alternatively or additionally, the line may be formed in a corkscrew, spiral or other configuration which irreversibly expands/extends under the longitudinal force. The extendible line portion may be formed by packaging, described elsewhere in this specification, of such a stretchable lifting line, i.e., by a combination of the extendible line portion embodiments described herein.

The extendible line portion forms a link between, or joins, the target mesh element and the object attachment point. The object attachment point may be, for example, a D-ring, O-ring, loop of rope or webbing, or any other suitable connection means, to which one end of the line included within or forming the extendible line portion may be attached via a knot or a more permanent fixing such as a stitched fixing. The fixing and/or object attachment point may comprise shock absorbing material or elements, to reduce the impact on the casualty or the rescuer as loads are generated during engagement with and recovery of the casualty, as described elsewhere herein.

The device may further comprise a winch connection point providing means for connecting the device to a winch mechanism, the connection point being positioned between the target mesh element and the end or end region of the extendible line portion proximal to the target mesh element. Such a connection point may be referred to as a "strong point" and may be provided by one or more elements forming substantial points or attachments or lift rings to allow the connection to a portion of a winch mechanism such as a halyard or other rope, which may then utilise a boat's sail lifting apparatus or other winch equipment in order to move the object to be retrieved, such as a casualty, towards the boat. However, a "winch" or "winch mechanism" as referred to herein contemplates any system, including those mentioned above, which enables one object to be pulled towards another and may include a simple manual pulling action by a rescuer. It may also involve a winch apparatus which is not necessarily capable of lifting a load upwards away from the surface of the water. The winch mechanism may be used simply to bring the casualty alongside a boat for manual lifting onboard, especially when the device according to the invention is intended for use by a user involved in inshore watersports where heavy seas are unlikely to be encountered, or for offshore commercial use where heavy seas may be encountered by vessels not having substantial mast or craning structures.

The positioning of the winch connection point between the target mesh element and the end or end region of the extendible line portion which is proximal to the target mesh element means that the extension of the extendible line portion allows a distance to be maintained between the casualty and the rescuer until secure connection has been made with or to the winch mechanism. At that stage, the casualty may be safely winched towards the boat or land on which the rescuer is located.

The object attachment point, lifting line and winch connection point are each and together capable of bearing a weight of at least about 50 kg. Typically, however, the object attachment point, lifting line and winch connection point will be capable of bearing weights far greater than this, for example, the full weight of a large grown man, wearing full ocean racing clothing saturated with water after a period of immersion in the sea. This may represent at least about 100 kg, for example at least about 110 kg, 120 kg, 130 kg, 140 kg, 150 kg, 160 kg, 170 kg, 180 kg, 190 kg or at least about 200 kg. A winch connection point may be anything suitable, such as a loop formed within a line forming part of the device (such as a portion of the extendible line), or a D-ring or metal loop or other strong attachment means to which the extendible line is joined, for example via one or more knots. The skilled person is readily able to contemplate suitable alternatives.

In the device according to the invention, the target mesh element may form the shape of a triangle or circle, or any other shape which assists in maintaining the target mesh element in an "open" configuration on the surface of the water. The target mesh element may comprise at least one inflatable portion, convertible from an undeployed (e.g., uninflated) to a deployed (e.g., inflated) state.

When deployed, the target mesh element may, as mentioned above, present or be formed by a web or net of lines in such a way as to facilitate or encourage the positive connection or capture by a boat hook or similar and prevent the same from an inadvertent release during any unexpected movement such as the pitching of the vessel, wrenching of the target or frantic interference of the casualty. Such lines may, therefore, provide or contribute to the structure of the target mesh element. The target mesh element structure is of sufficient strength that it can bear the load of the initial connection between a rescuer and the object or casualty to be retrieved, including the longitudinal force required to cause the extendible line portion to extend. The target mesh element lines may be made more visible by being surrounded, for example, by sheaths of high-visibility material such as a plastic, or may be formed themselves by a high-visibility material and/or may comprise elements which become illuminated on contact with water.

The target mesh element may also ideally be engageable with a further object such as a boat winch or cleat, or to a land-based mooring point or other fixed object. This enables the casualty to be connected to the further object, for example to a boat via a cleat, in the time period while the extendible line portion is extending, between the time of initial engagement of the rescuer with the target mesh element and the time at which the extendible line portion is fully extended. This time period may suitably be up to about 60 seconds, for example up to about 30, 25, 20, 15 or 10 seconds. A preferred time period is about 3-20 seconds, for example 3-15 seconds. Therefore, the rescuer does not bear the full load of the casualty manually at any point (whether directly via a manual grip or indirectly via a boat hook or other engagement means), this load instead being applied to the cleat after the target mesh element has been engaged with it. This provides a significant advantage over existing rescue devices and methods. The casualty is then secure, allowing time for the rescuer to connect a winch mechanism to the winch connection point located close to the target mesh element and effect the process of drawing the casualty towards the boat and, ultimately, onboard.

At points where individual lines within or forming the net or web of the target mesh element intersect or engage with one another, they may be arranged to move relative to one another or may be immobilised together by a knot or other binding element at each intersection. This latter arrangement has the advantage of retaining the overall open net structure of the target mesh element, even after it has been engaged by a rescuer. This enables other apertures in the structure to remain in a substantially open configuration, for more ready engagement with a further object such as a boat winch or cleat. Where individual lines are allowed to move relative to one another, engagement by a rescuer with the target mesh element may cause a collapse of the overall structure of the target mesh element, making it more difficult, during a rescue operation, for a rescuer to engage the target mesh element with the further object such as a boat winch or cleat.

Preferably, the inflatable target mesh element portion or portions are formed to create a structural support for, or to form, the target mesh element or target mesh elements. In a preferred arrangement, the structural support portion or portions are individually or together formed to be arranged in approximately a "Δ" or "○" (which may encompass a generally circular shape such as a hexagon) or "□" or "◇" or "*" or "Π" or "T" shape. Other suitable arrangements of the structural support will be obvious to the skilled person, for example an "L" shape. "H", "X", "Z" and "W" shapes all provide possible alternatives. Additionally, these shapes may comprise further sections such as to form a three dimensional shape such as a pyramid or cube. None of these suggestions should be considered to be limiting.

More than one target mesh element may be included in the device. Where more than one is included, these may be separately deployable. For example, the target mesh elements may be separately inflatable, with the second (or subsequent) element deployed if the first target mesh element fails for some reason, for example if it is dropped by a rescuer during the process of engaging with it. The inflation of a secondary or subsequent target might be initiated by the casualty, or after a time delay, or may be triggered by engagement with and subsequent release of the first target (which might be detected, for example, by way of pressure sensors included in the device).

Advantageously, the arrangement of the target mesh element being attached or linked to the extendible line portion (or formed at least partially by an end portion of it), which is preferably itself buoyant, has the effect of providing a visualisation element (i.e., the deployed target mesh element) which remains in an "open" or "flat" configuration when the device is deployed, for example, attached to an object floating in a liquid such as water. This facilitates a rescuer making visual contact with the object/casualty. The overall "open" shape of the target mesh element is maintained such that significant folding or entanglement does not occur with the unextended extendible line or with the object. The primary components remain downwind of their attached object and "ride the waves", remaining at or near the surface of the water and not suffering any of the prior art problems of tending to tangle around the casualty and/or requiring operations from the casualty or multiple manoeuvres from the rescue vessel.

A further advantage is provided by the attachment of the device to the object at a pivot point, in which case the object attachment point may also be referred to a "pivot point". This means that the device is attached to the object at a point around which the device as a whole is free to move and does not extend as a tangled or knotted line attached to the object. Therefore, the device is free to move, regardless of the orientation or facing direction of the object or casualty, in accordance with the action of wind and/or the movement of water surrounding the object. Therefore, the device does not become entangled with the object. The target mesh element maintains an "open" or "flat" configuration visible from nearby craft. However, the device may be attached to the object at more than one pivot point, provided that any attachment maintains this freedom to move in accordance with wind/water action, when the device is in the water.

The arrangement of the means for attachment of the device to the object, with spatial separation between the object and the target mesh element by the linking of the target mesh element and the object attachment point by the extendible line portion, provides the advantage that a user partly or fully submerged in water may be initially "grabbed" or contacted by a rescuer via the target mesh element which is not on or near the user, although it is firmly attached to them. The rescuer and/or casualty may be protected from undue sudden physical shock, resulting from the forces caused by the engagement between the rescuer and the target mesh element, by the inclusion of shock absorbing material in the object attachment point and/or in the material forming a buoyancy aid to which the device is attached, as described further below. For example, this might be achieved by a portion of the lifting line included in the extendible line portion being formed or partially formed by shock cord (or "bungee" cord), or by the extendible line portion being linked to the object attachment point via a length of shock cord. Alternatively, the whole or part of the lifting line included in the extendible line portion may be formed by a combination of shock cord and non-elastic line, for example a length of shock cord with non-elastic line coiled around it. Other suitable means for reducing the physical shock experienced by a rescuer and/or casualty during operation of the device will be readily envisaged by the skilled person.

The structural support of the target mesh element of the device may also provide a large area of highly visible material on the surface of the water when in the deployed state, to assist with visual identification of the position of a casualty. For example, the target mesh element may comprise a film of material extending across the target mesh element (e.g., across the face of the target mesh element shape such as "Δ" or "○" or "□", etc.) to form a large area of visible material. The film may be piercable by the action of a rescuer engaging with the target mesh element, for example, by means of a boat hook or similar. When deployed, the target area structural support is held in a pre-determined shape and kept buoyant, as described above. Since the basic structure is maintained in this way, the deployed device "rides the waves", i.e., remains on or near the surface of the water in a pre-determined "open" configuration.

The film material included in the target mesh element may have a thickness of at least approximately 50 μm. One factor in determining an appropriate thickness is colour density which may be further reduced in water, such that less than 50 μm can become transparent in the case of some materials. Any material or combination of materials is suitable provided it has sufficient strength, visibility and is detectable by visual means or other means such as radar or sonic systems.

Preferably, the object is a person or a lifejacket, Lifesling®, life raft or other buoyancy or rescue aid, a bag, or the clothing worn by a person, but it may also be an object to be worn by or used by a person, such as (but not limited to) a container such as a box, a tool and/or tool belt.

The device (or a portion thereof, such as the target mesh element) may be convertible between an undeployed state (in which it is packaged to form a compact unit locatable, for example, within the structural folds of an undeployed lifejacket or on the surface of clothing being contained within the design of such, or attached to a life sling, buoyancy aid or other object as previously mentioned) and a deployed state in which the target mesh element is buoyant and/or inflated, with the extendible line portion free to float in unextended form between the object and the target mesh element. Alternatively, the extendible line portion may remain within a further structure such as a lifejacket, with only the target mesh element being deployed and free to float on the water.

As part of clothing, the undeployed device and/or undeployed target mesh element may take the form of a patch or badge worn on the surface of the clothing with the extendible line contained within a section of clothing that attaches to or forms a structural component sufficient to support the person. This has the advantage that, in the undeployed state, the device and/or target mesh element is small and can be worn routinely without impairing freedom of movement of the user.

In addition, the device can be affixed to the surface of buoyancy aids and other emergency equipment without adversely affecting the rapid deployment and operation of such equipment as can be the case with, for example, the Lifesling® or Seattle Sling. The device may also be located within the structure of such equipment, provided it is located so that it can be converted from an undeployed to a deployed state, as described above.

Where the target mesh element structural support is not formed using buoyant materials, as mentioned above the element itself may be formed by at least one inflatable portion, preferably at least one portion being inflatable independently from another portion, so that deflation of one portion does not result in deflation of the whole inflatable portion. Each portion of the inflatable portion may be formed by a single inflatable chamber, or may comprise a series of inflatable chambers, either linked to one another or formed discretely from one another. Each inflatable chamber may be individually inflatable, or inflatable by connection to one or more other inflatable chambers.

The inflatable structural support portion may be inflatable by gas or another substance such as water reactive foam. Inflation may be triggered automatically (for example on contact with water), or manually, or by a combination of automatically and manually activated systems.

The means for inflation included in the structural support may comprise, for example, a pressurized gas container which, when triggered, releases gas into at least one inflatable portion. In one embodiment, triggering of such a container may be actuated by trigger means formed from a soluble material such that, when the trigger means is contacted by water or other liquid into which the object has fallen, the trigger means dissolves, thereby activating the release of gas from the gas container. The gas container may be connected to the inflatable portion of the device by any conventional means and may further be mounted on or within the device by means which will readily be determined by the skilled person. Such a container may be of equivalent or similar dimensions to containers already routinely included in some lifejackets to facilitate inflation on submersion in water.

Alternatively, inflation may be achieved by mixing of a liquid and appropriate solid material, the solid material being any which, on contact with water or another liquid, releases gas in a non-explosive manner. For example, in one non-limiting embodiment, a mixture of solid bicarbonate of soda and solid citric acid at a ratio of about 1:3 in a solid volume of 3 $cm^3$, injected with about 5 ml of about 5% acetic acid solution (for example, commercially available white vinegar), has been found to be effective. However, the particular means of inflation is not typically critical and any suitable alternative inflation means readily may be envisaged by the skilled person.

Full inflation of the structural support may preferably be achieved by about 3 minutes after the initiation of deployment (for example, on immersion of the device in water), for example by about 2, 1.5 or 1 minutes or by 30 seconds. Preferably, full inflation is achieved by about 10-20 second, most preferably by about 15 seconds after initiation of deployment. "Full inflation" indicates sufficient inflation of structural support of the target mesh element that the element forms and maintains a substantially "open" configuration as described above, capable of "riding the waves" on the liquid surface.

The device may further comprise manual inflation means such as a tube into which a user can blow to inflate the structural support, which inflation means may comprise a one-way valve.

All or a part of the device, particularly that forming the structural support portion of the target mesh element, may be formed from a high visibility material. High visibility material may be material which is visible to the naked eye, such as brightly coloured and/or fluorescent and/or reflective material. Alternatively or additionally, the material may be visible by other detection means, for example it may be a radar reflective material or a material detectable using sonic methods. The material may also comprise elements which can be illuminated, such illumination being activated, for example, when the device is immersed in a liquid. In any embodiment, the material may be a plastics or fabric material such as linear low density polyethylene (LLDPE) or Mylar®, by way of non-limiting example. The material may be biodegradable.

The extendible line (or lifting line) will ideally be able to float unaided, should have a small cross section and a high load bearing capacity for its size. By way of non-limiting examples, materials like polypropylene are ideal in many ways for such an application but this requires almost 50% greater diameter than materials such as Dyneema® fibre or Vectran® fibre which are, therefore, particularly suitable. For example, one (non-limiting) grade of Dyneema® fibre has lines with a diameter of 4 mm and breaking strain of 490 kg. The skilled person will readily be able to contemplate alternative materials suitable for use as part of the present invention. The material may be biodegradable.

By way of non-limiting example, the extendible line portion may extend to a length of at least about 2 m for example, to a length of 2-30 m, or 5-15 m, ideally to about 5, 6, 7, 8, 9 or about 10 m. The maximum extension of the extendible line portion may be set in accordance with the conditions in which a particular device is intended to be used. For example, a device for use in the open ocean may have a maximum extension for the extendible line portion which is greater than the maximum extension for a device for use on inshore waters. In non-extended form, the extendible line portion may be packaged in a containment package having a length of, for example, about 20-50 cm, such as about 25, 30, 35 or about 40 cm. The circumference of the containment package may be, for example, about 5-20 cm, such as about 5-15 cm or about 5-10 cm. Dimensions are not critical and will substantially depend on the packed volume of the non-extended extendible line.

The lifting line may also be formed by doubling back on itself, that is, extending between a winch connection point to the object attachment point and then returned from the object attachment point to a second winch connection point, allowing an additional winch line from the vessel to be attached to the second winch connection point, providing a doubling of mechanical force for a given effort of the rescuer.

The device may carry any other safety and/or attention-seeking aids as may be required, for example, such as whistles or lights, including but not limited to lights being built inside the structural support for the target mesh element and/or container for the lifting line element.

A second aspect of the invention provides a buoyancy aid comprising a device according to the first aspect of the invention. The buoyancy aid may be a lifejacket, Lifesling®, life raft or other buoyancy or rescue aid, by way of non-limiting example. The device according to the invention may be formed within the buoyancy aid by separate components located within or on the buoyancy aid, together forming the device. For example, the extendible line portion may be linked to the target mesh element indirectly, via the material forming the buoyancy aid. Alternatively, the device may be provided as a wholly formed device forming a component of the buoyancy aid and/or being located within or on it.

A third aspect of the invention provides a method of making a buoyancy aid according to the second aspect of the invention, comprising attaching a device according to the first aspect of the invention, or components thereof, to the buoyancy aid. Such a step may be completed during the original manufacturing of the buoyancy aid, or may represent a retro-fitting activity utilising an existing buoyancy aid.

Where the buoyancy aid is a lifejacket, the method may further comprise providing a crotch strap to the lifejacket capable, when in use and fitted around a wearer, of bearing a weight of at least 50 kg. Preferably, the strap can bear a weight of at least about 100, 110, 120, 130, 140, 150, 160, 170, 180, 190 or about 200 kg. Crotch straps on conventional lifejackets and/or the means for connecting the strap to other parts of the lifejacket and/or the means for securing the strap in place around a user wearing the lifejacket, are often of insufficient strength to be capable of withstanding the load when a user is lifted from the water using the lifejacket as a gripping point. If the crotch strap or other fixing breaks or otherwise fails, this might result in the casualty falling back into the water. Therefore, retrofitting an existing lifejacket with a device according to the invention may also require a step of upgrading the material forming the crotch strap and/or the associated fittings, linkages or closing mechanisms.

A fourth aspect of the invention provides a method of retrieving an object such as a casualty from the water, the object being attached to a device according to the first aspect of the invention or a buoyancy aid according to the second aspect of the invention, comprising:

a) a step or action of a rescuer engaging with (i.e., making engagement with or becoming engaged with) a deployed target mesh element, for example directly by hand or indirectly via a pole, boat hook and/or hook and line;

b) enabling/causing sufficient pressure to develop between the target mesh element engaged with the rescuer (for example, with the pole or boat hook) and the object attachment point, such that the extendible line portion extends.

For example, (b) might be achieved by the rescuer who has engaged with the target mesh element (for example using a boat hook) pulling the target mesh element towards them. Alternatively or additionally, the target mesh element may be held stationary and/or engaged at a fixed location and the relative motion of the boat and/or the object in the water may be sufficient to apply the necessary longitudinal pressure to the extendible line portion such that it extends.

The method may further comprise subsequently immobilising the target mesh element at a fixed point close to the rescuer, typically on a boat on which the rescuer is located, or engaging the target mesh element with such a fixed point. For example, the fixed point may be a winch block or rope cleat, by way of non-limiting example.

When the device comprises a winch connection point, the method may further comprise:

c) linking or engaging the connection point to a winch mechanism positioned on a boat or on land;

d) moving the connection point linked in step (c) so as to cause the first object to move towards the boat or land on which the winch mechanism is positioned/located.

For example, the connection point might be attached to the free end of a lanyard such that the sail lifting apparatus of a boat might be used to winch the object towards the boat and then, optionally but preferably, to lift the object upwardly out of the water, ultimately positioning the object such that it can be brought onboard the boat. Such a method will be described in more detail below.

For avoidance of doubt, where reference is made herein to "boat" or "vessel", any floating vessel is contemplated, for example (but not limited to), a surfboard, windsurfer, jetski, rowing boat, skiff, launch vessel, dinghy, yacht, ship or oil platform.

Throughout the description and claims of this specification, the words "comprise" and "contain" and variations of the words, for example "comprising" and "comprises", mean "including but not limited to" and do not exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Preferred features of each aspect of the invention may be as described in connection with any of the other aspects. Generally speaking the invention extends to any novel one, or any novel combination, of the features disclosed in this specification (including any accompanying claims and drawings). Thus, features, integers or characteristics, described in conjunction with a particular aspect, embodiment or example of the invention are to be understood to be applicable to any other aspect, embodiment or example described herein, unless incompatible therewith. Moreover, unless stated otherwise, any feature disclosed herein may be replaced by an alternative feature serving the same or a similar purpose.

Advantages of the various features of the device as outlined above will now be described in more detail with particular reference to a method of operating the device. This description is provided by way of example only and referring to FIGS. 1-10 in which.

EXAMPLE OPERATION OF THE INVENTION

The Man Overboard Recovery System described herein is a system which brings together core components and adapts those technologies to fit into a relatively small package or patch. Due to the ergonomic design, it can be manufactured or retro fitted into lifejackets and other devices without adversely increasing their size or interfering with their operation or effectiveness. Also, it can be manufactured into clothing that users will be more inclined to habitually wear regardless of how benign the conditions may be. This device may remove a considerable number of difficulties and dangers that are manifest for both the casualty and rescuers in such perilous circumstances, reduce the time taken to recover the casualty and, consequently, enhance their chances of survival.

The device is not intended as a primary buoyancy aid or life preserver although there are buoyant compartments as part of the structure that may offer additional buoyancy and relief to a casualty. However, the device may be incorporated into a buoyancy aid or life preserver.

Unlike prior art systems, the device utilises the standard equipment available on the vast majority of vessels of all sizes. It embraces natural attributes of wind, water and vessel handling and manoeuvring characteristics to increase the chances of successful capture of the deployed device, thereby maximising the chances of a rescuer safely and quickly recovering a casualty without further risk to themselves.

Figure 1:
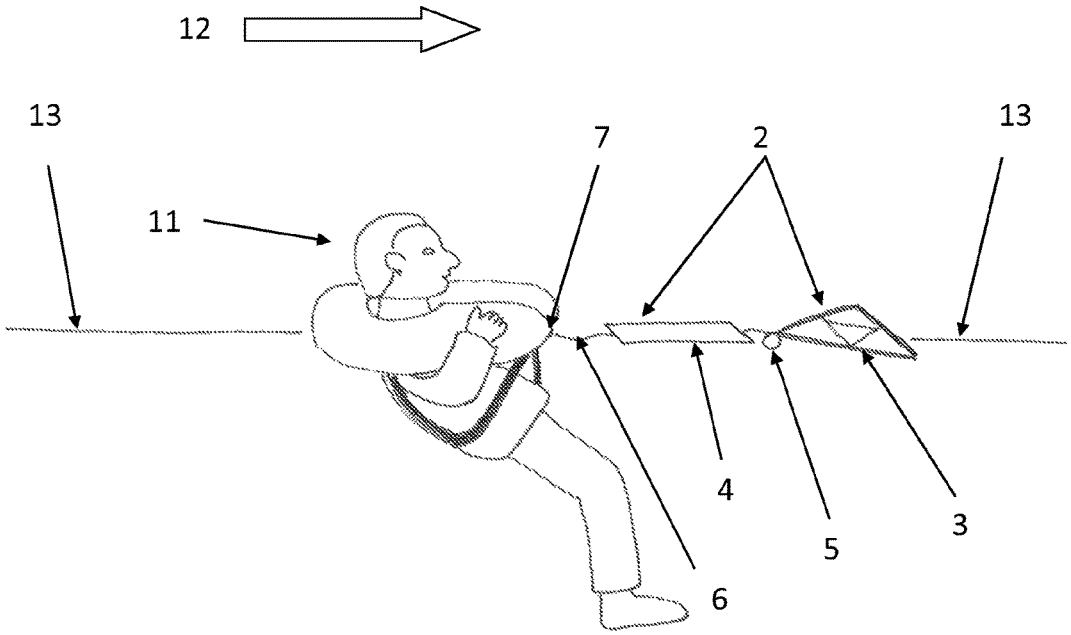
FIG. 1 shows a casualty in the water attached to a device according to the invention.

FIG. 1 shows a casualty (11) in the water with a deployed device (2) according to the invention. The device comprises a target mesh element (3) which is formed by inflatable portions so that it is kept at or near the surface 13 of the water, riding the surface of the waves. It is attached to a buoyant packed lifting line element (4). A lifting ring (5) is located between the target mesh element and the packed lifting line. In the illustrated embodiment, the target forms a triangle. The device further comprises a tether (6) which attaches to the casualty at a pivot point (7) with the result that the whole device extends away from the casualty by the action of wind and waves (in the direction of arrow 12). The casualty can position themselves so they are facing away from the waves (to minimise the inhalation of spray) without fear of becoming entangled with the device, since the device will tend to extend away from the casualty, downwind or downstream regardless of the direction in which the casualty faces. This is the result of the use of attachment of the device to the casualty at a pivot point and, in this embodiment, the length of lifting line acting as a tether which also spatially separates the deployed device from the casualty and the separate elements.

This device is deployed when or as the object (in this case a casualty) enters the water. As the target area deploys it provides a large, highly visible area that may be laced with a sufficient quantity of line to capture a boat hook or similar when brought into contact inside the target area.

Figure 2:
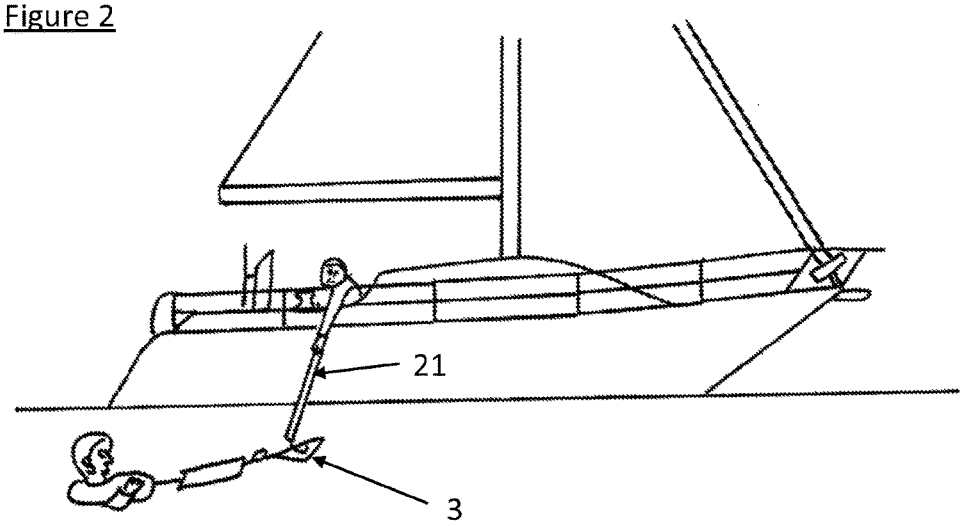
FIG. 2 shows a rescuer reaching from a boat to engage a boat hook with a target element of the device.

FIG. 2 shows a rescue vessel approaches to position downwind of the target at less than 2 knots thus maintaining accurate control of the vessel, providing a more stable platform for the rescuer and reducing the threat to the safety of the casualty. The rescuer then deploys a boat hook (21) or similar to snag the target (3). The hook will also be able to cope with a large relative motion between the vessel and the target without losing contact or risking pulling the rescuer overboard, as well as being effective without any intervention by the casualty. This could, therefore, deal with an unconscious casualty or one who had lost dexterity.

Figure 3:
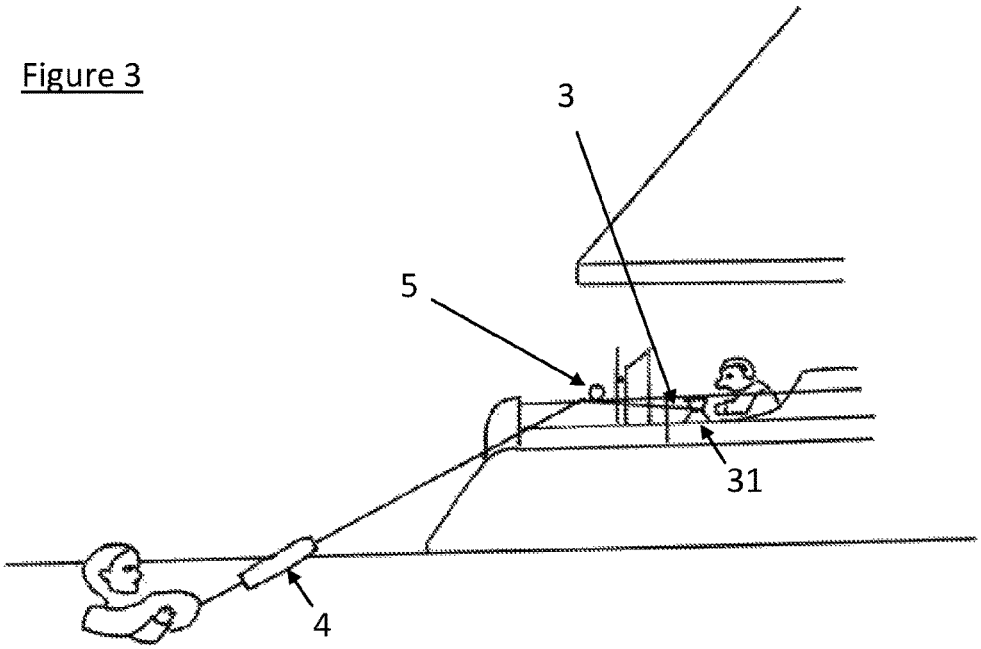
FIG. 3 shows the extendible line in extended form and the winch mechanism connection point engaged with a halyard on the boat.

FIG. 3 shows once snagged and pulled, the lifting line pays out from the lifting line container (4) under a predetermined and significant, but relatively light, load that both indicates to the rescuer they have firmly captured the target and ensures the line is kept clear of the water thus preventing contact with the propeller or debris.

The lifting line can be any length. However, a vessel travelling at approximately 1 knot is covering 0.5144 meters per second. Therefore, if there is contained 4-6 meters of line and the target is picked close to and on a parallel course to a deck at 1.5 meters height, the rescuer will have between 3 and 11 seconds after snagging the target (3) and before the full load of the casualty is placed on the target. FIG. 3 shows that, during this time, the rescuer will immediately place the target mesh element over a winch (31), cleat or other strong point ready to take the full load of the casualty. Also, the boat hook can still be left attached to the target, if too entangled for instant release.

Figure 4:
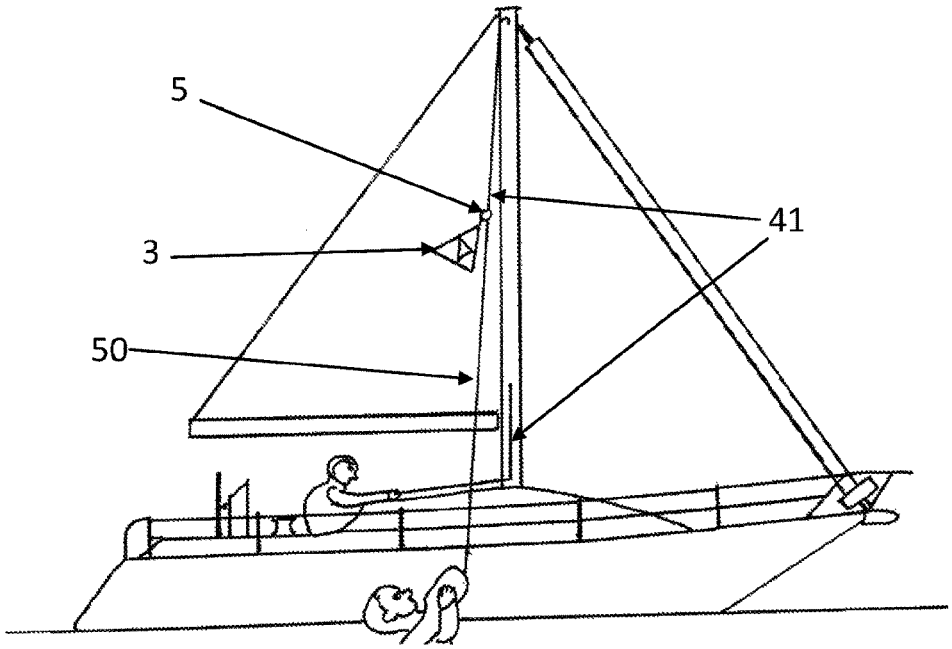
FIG. 4 shows the sail lifting apparatus of the boat being used to lift the halyard such that the connection point is lifted up the mast, thereby drawing the casualty towards the boat, upwards out of the water and, ultimately, to a position where they can be pulled onboard.

FIG. 4 shows the rescuer bringing the vessel to a halt then fixing a halyard (41) or other lifting apparatus to the highly visible lift ring (5) strong point positioned between the target (3) and the lifting line, the target now sitting misshapen whilst the winch (31) takes the strain of the casualty load via the lifting line (50) which is now fully extended from the packed lifting line element (4). Once the load is taken on the halyard (41) the target (3) is easily lifted or un-snagged from the winch (31) or cleat and released to hang free. The rescuer then pulls in all the slack or moderately loaded line until the full weight of the casualty is borne by the halyard (41) when the casualty comes alongside the vessel. The rescuer then utilises a standard winch and begins the process of lifting the casualty until the casualty can be pulled aboard onto the deck and safety.

Figure 5:
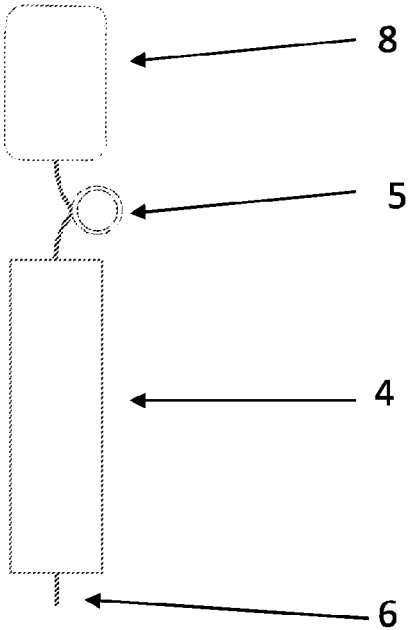
FIG. 5 shows the device in an undeployed state with the extendible line packaged in unextended form.

FIG. 5 shows an undeployed device with the target mesh element packaged into a compact unit or pod (8) ready to release the inflatable target mesh element. The same compact pod design is possible with other non-inflatable buoyant materials as would be clear to the skilled person. The attached packaged lifting line (4) and lifting ring (5) are shown attached to the pod (8) with the lifting line acting as a tether (6) linked to the attachment point 7, shown in FIG. 6 as a D-ring (61) (device of the invention not shown).

Figure 6:
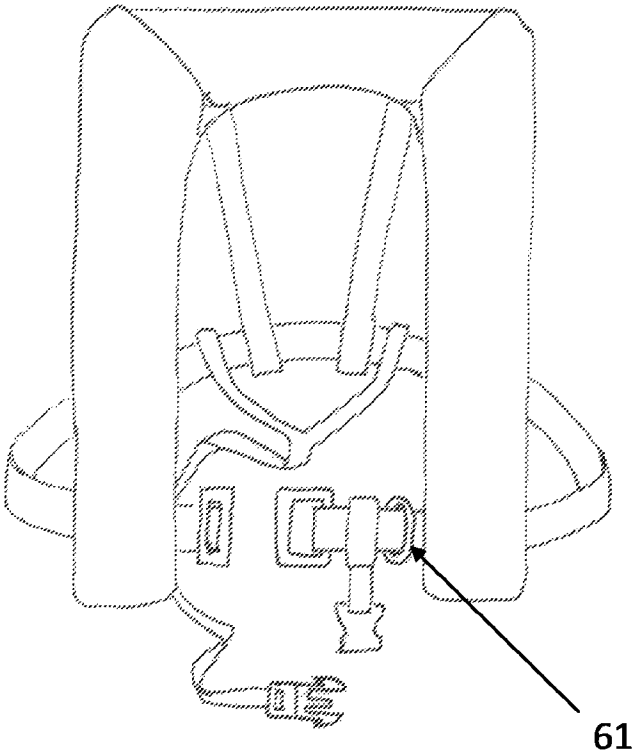
FIG. 6 shows a conventional lifejacket ready for a person to wear.

FIG. 6 shows a typical inflation type lifejacket packed as would be ready for a person to wear. In this example the gas cylinder and deployment controls are contained in the left side of the image of the lifejacket.

Figure 7:
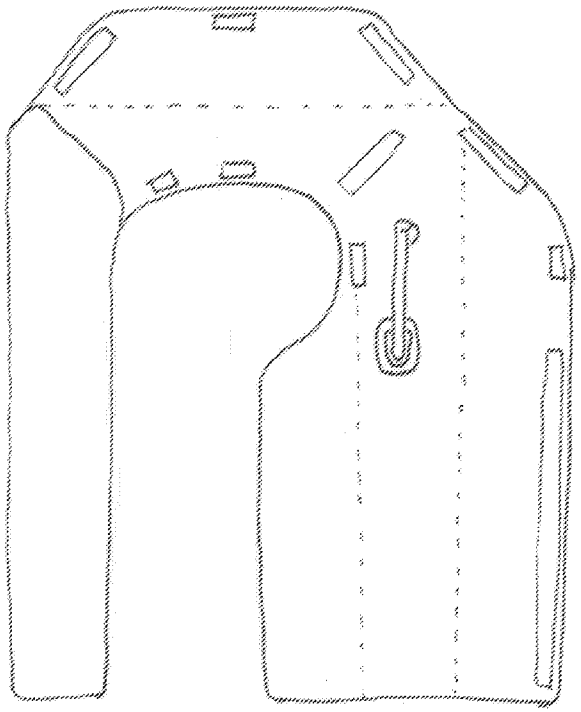
FIG. 7 shows the interior structure of a conventional lifejacket.

FIG. 7 shows the same jacket (webbing removed to aid clarity) with the section to the right of the viewer opened out to demonstrate the available space.

Figure 8:
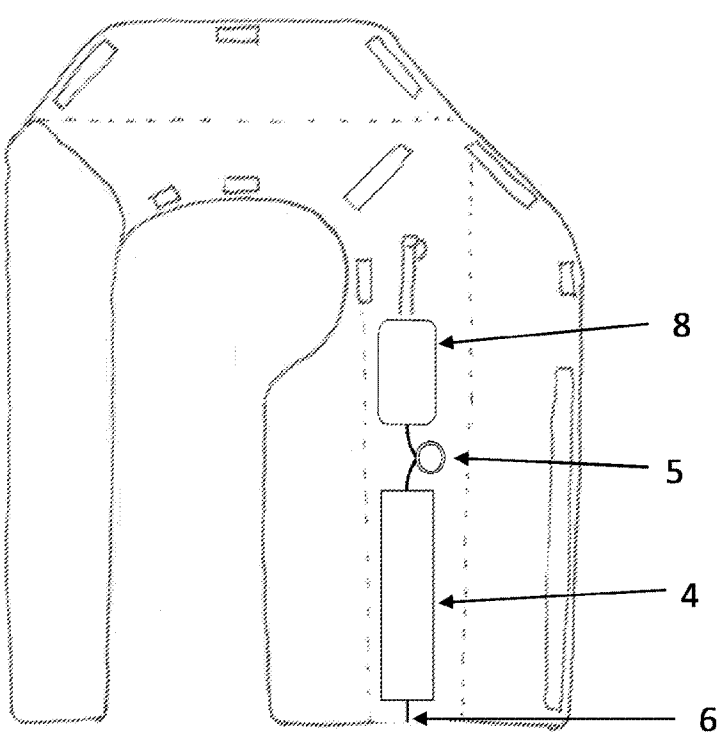
FIG. 8 shows a device according to the invention retrofitted into the interior of a conventional lifejacket.

FIG. 8 shows the installation of the device into this space prior to the section of the jacket being closed, and the path of the strong line 6 to connect to the "D" ring, lifting Becket loop or other strong point within the webbing (not shown).

Figure 9:
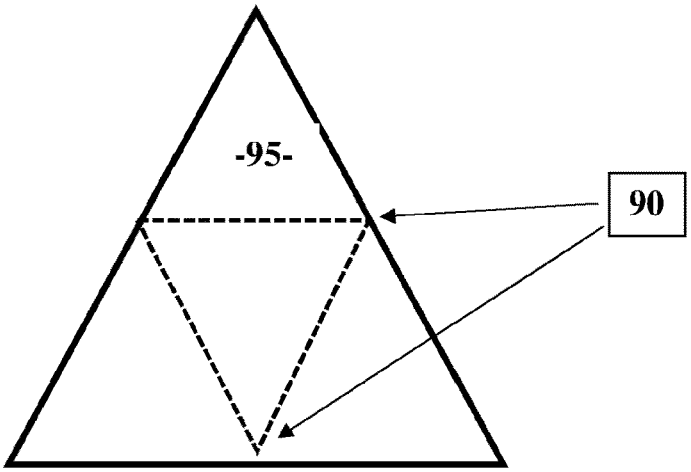
FIG. 9 shows various arrangements for lines and inflatable portions forming the target mesh element.
Figure 9:
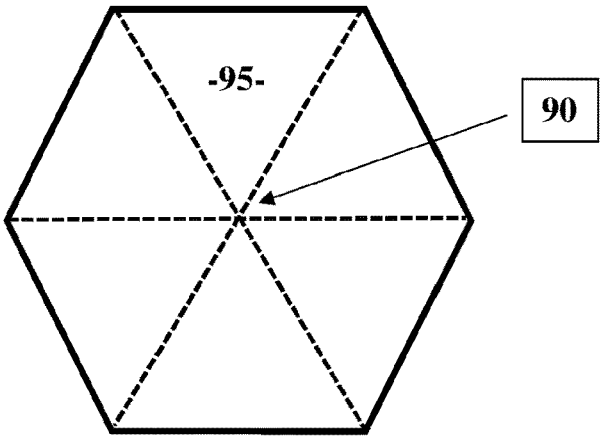
Figure 9:
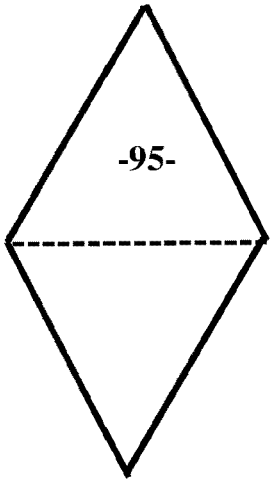

FIG. 9 shows non-limiting arrangements for the target mesh element. Lines marked with a heavy line may be formed by or be surrounded by inflatable portions, for example by lengths of Dyneema® line surrounded by an inflatable sheath. Dotted lines indicate optional additional lines which may also be inflatable portions, or may be simple lines. Where the lines meet at intersection points, some of which are marked "90", they may be immobilised relative to one another by a knot or other fixing means. Alternatively, where the lines intersect at these points, they may be moveable linked to one another via a loop or other structure allowing relative movement between the lines. However, the benefit of immobilising the lines relative to one another is that, if the target mesh element is engaged via aperture 95 with a boat book, for example, the other apertures in the structure remain open and may more readily be used to engage with a cleat or other part of a boat. Where lines are able to move relative to one another, capture through aperture 95 with a boat hook will tend to result in the collapse of the whole structure, making it more difficult to engage the target mesh element with the boat.

Figure 10:
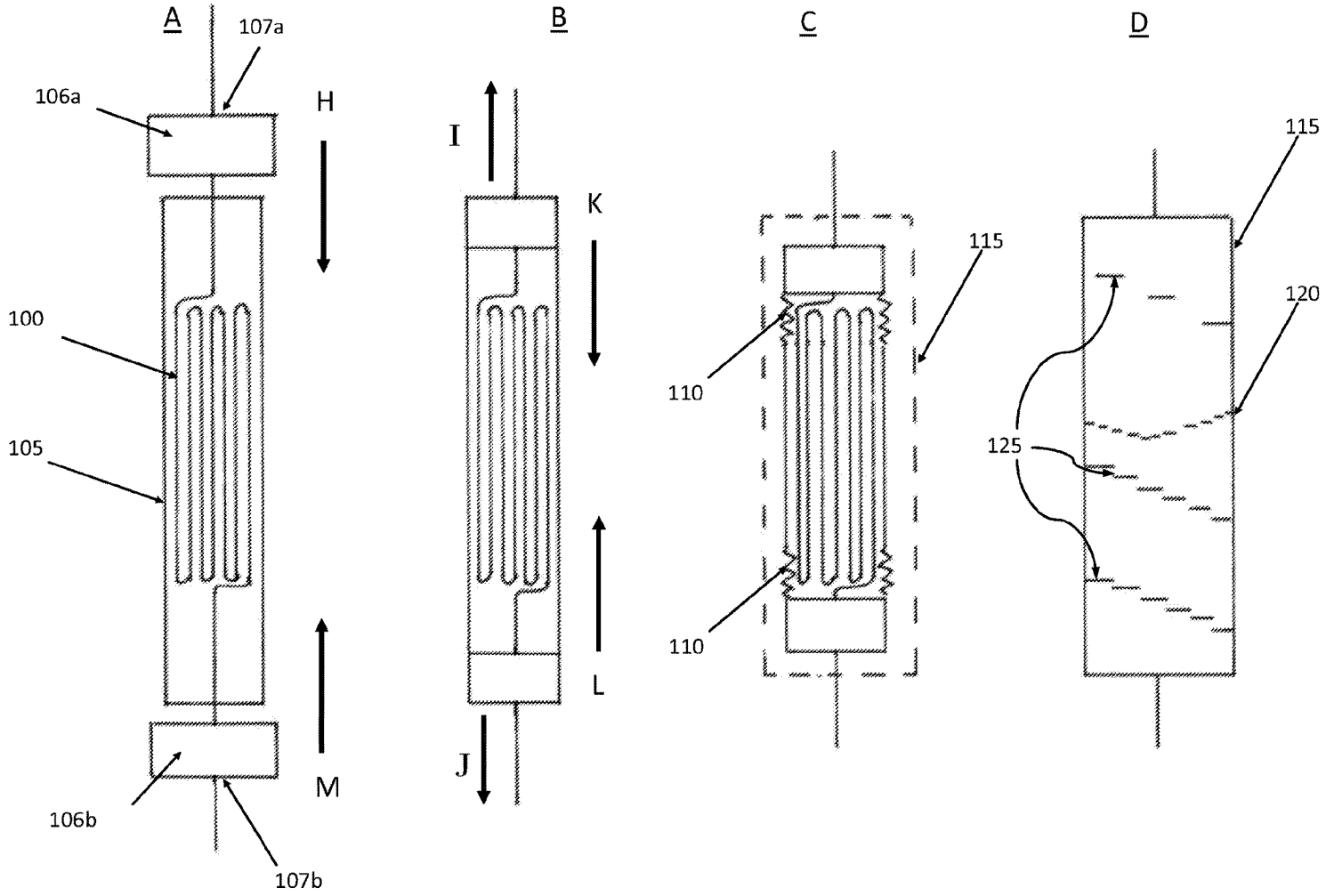
FIG. 10 shows packaging of a line into a package comprising an inner casing and an outer casing.

FIG. 10 shows construction of a lifting line container comprising an inner and an outer casing. The lifting line 100 is first packed into a tube 105 and rubber bungs 106*a* and 106*b* are urged onto the ends of the tube 105 in the direction of the arrows H and M, respectively, to form the packaged line in FIG. 10B. The line 100 emerges from the tube via the centre of each bung at points 107*a* and 107*b*, respectively. The material of the bungs 106*a* and 106*b* make sufficient frictional contact around the line 100 that it cannot slip out of the tube unless it is subjected to a significant longitudinal force in the direction of the arrows I and J, respectively.

The package shown in FIG. 10B is then compacted by forcing the ends towards one another in the direction of the arrows K and L, to further tightly pack the line 100 within the tube 105 and causing compression at regions 110 of the tube 105. The compressed package is then surrounded by an outer container marked 115 in FIG. 10C. An exterior view of this outer container is shown in FIG. 10D. The outer container 115 may comprise a perforated belt 120 around a circumference of the container, or may comprise points of weakness 125 at various positions in the container material, or both. Either system will enable the material of the outer container to tear or fail in the event that a knot in the line 100 causes strain against the bungs 106*a* and/or 106*b* as the line is pulled from the packaging. This strain is relieved by the expansion of the compressed regions 110, which is allowed to occur after a given load by the failure of the outer packaging 115. Therefore, outer packaging 115 acts as a "fuse" to protect against, or reduce the likelihood of, the displacement of the bungs 106*a* and/or 106*b* in the event of non-smooth deployment of the line 100 from the tube 105.

The invention claimed is:

1. A device for recovering an object from water comprising an object attachment point that is capable of attaching the device to the object, an extendible line portion that is extendible when placed under longitudinal pressure, a target mesh element that is inflatable and/or buoyant, and a winch connection point providing means for connecting the device to a winch mechanism, the connection point being positioned on or between the target mesh element and the end or end region of the extendible line portion proximal to the target mesh element, wherein the connection point is joined to the remainder of the device by a link capable of bearing a weight of at least 50 kg, wherein the object attachment point and the target mesh element are linked by the extendible line portion, and wherein the extendible line portion is a packed length of line.

2. The device of claim 1 wherein the extendible line portion is formed as a package such that each end of the line emerges from the package at a different point, wherein the line remains in packaged form until a longitudinal force is applied to one or both ends of the line.

3. The device of claim 2 wherein the package is essentially cylindrical.

4. The device of claim 3 wherein one end of the line emerges from the cylindrical package at one end and the other end of the line emerges from the other end of the package.

5. The device of claim 1 wherein one end of the line is fixed within a package forming the extendible line.

6. The device of claim 1 wherein the extendible line portion is irreversibly extendible.

7. The device of claim 1 wherein the extendible line portion is extendible under a longitudinal pressure of at least about 5 N.

8. The device of claim 1 wherein the target mesh element forms the shape of a triangle or circle.

9. The device of claim 1 wherein the target mesh element comprises at least one inflatable portion, convertible from an undeployed to a deployed state.

10. The device of claim 1 comprising shock absorbing material in the extendible line portion and/or at or in the object attachment point and/or in the material forming a buoyancy aid to which the device is attached.

11. The device according to claim 2 in which the package comprises an inner and an outer casing.

12. The device of claim 11 wherein the inner casing is surrounded by the outer casing arranged to cause compression of end regions of the inner casing, further wherein the outer casing comprises a region of weakness capable of structural failure, in use, in the event that smooth deployment of the line is interrupted by the presence of a knot or tangle in the line.

13. A buoyancy aid comprising the device of claim 1.

14. A method of making the buoyancy aid of claim 13, comprising attaching a device to the buoyancy aid, the device comprising an object attachment point that is capable of attaching the device to the object, an extendible line portion that is extendible when placed under longitudinal pressure, a target mesh element that is inflatable and/or buoyant, and a winch connection point providing means for connecting the device to a winch mechanism, the connection point being positioned on or between the target mesh element and the end or end region of the extendible line portion proximal to the target mesh element, wherein the connection point is joined to the remainder of the device by a link capable of bearing a weight of at least 50 kg, wherein the object attachment point and the target mesh element are linked by the extendible line portion, and wherein the extendible line portion is a packed length of line.

15. The method of claim 14 wherein the buoyancy aid is a lifejacket, further comprising providing to the lifejacket:

a) a crotch strap; and/or b) means for connecting a crotch strap to other parts of the lifejacket; and/or c) means for securing a crotch strap in place around a user when wearing the lifejacket;

wherein the crotch strap and/or means for connecting and/or means for securing is capable, when the lifejacket in use and fitted around a wearer, of bearing a weight of at least about 50 kg.

16. A method of retrieving an object in the water, the object being attached to a device comprising an object attachment point that is capable of attaching the device to the object, an extendible line portion that is extendible when placed under longitudinal pressure, and a target mesh element that is inflatable and/or buoyant, wherein the object attachment point and the target mesh element are linked by the extendible line portion, and wherein the extendible line portion is a packed length of line, the method comprising:

a) a rescuer engaging with the target mesh element;

b) the rescuer enabling pressure to develop between the target mesh element engaged with the rescuer and the object attachment point, such that the extendible line portion extends.

17. The method of claim 16 further comprising subsequently immobilising the target mesh element at a fixed point.

18. The method of claim 16 wherein the object is attached to the device wherein the connection point is joined to the remainder of the device by a link capable of bearing a weight of at least 50 kg, further comprising:

c) linking the connection point to a winch mechanism positioned on a boat or on land;

d) moving the connection point linked in step (c) so as to cause the first object to move towards the boat or land.

19. The device of claim 1 wherein the device is wearable.

* * * * *